US010074318B2

(12) United States Patent
Zhang et al.

(10) Patent No.: US 10,074,318 B2
(45) Date of Patent: Sep. 11, 2018

(54) APPARATUS AND METHOD FOR CONTROLLING LIQUID CRYSTAL DISPLAY BRIGHTNESS, AND LIQUID CRYSTAL DISPLAY DEVICE

(71) Applicant: HISENSE ELECTRIC CO., LTD., Qingdao (CN)

(72) Inventors: Yuxin Zhang, Qingdao (CN); Shunming Huang, Qingdao (CN); Zhicheng Song, Qingdao (CN)

(73) Assignees: HISENSE ELECTRIC CO., LTD., Qingdao (CN); HISENSE USA CORPORATION, Suwanee, GA (US); HISENSE INTERNATIONAL CO., LTD., Qingdao (CN)

( * ) Notice: Subject to any disclaimer, the term of this patent is extended or adjusted under 35 U.S.C. 154(b) by 91 days.

(21) Appl. No.: 15/173,205

(22) Filed: Jun. 3, 2016

(65) Prior Publication Data

US 2017/0061897 A1 Mar. 2, 2017

(30) Foreign Application Priority Data

Sep. 1, 2015 (CN) ..... 2015 1 0550065

(51) Int. Cl.
*G09G 5/10* (2006.01)
*G09G 3/34* (2006.01)

(52) U.S. Cl.
CPC ..... *G09G 3/3426* (2013.01); *G09G 2320/064* (2013.01); *G09G 2360/16* (2013.01)

(58) Field of Classification Search
USPC ..... 345/102, 207, 690, 698
See application file for complete search history.

(56) References Cited

U.S. PATENT DOCUMENTS 7,436,415 B2 10/2008 Takata et al.
7,638,754 B2 12/2009 Morimoto et al.
(Continued)

FOREIGN PATENT DOCUMENTS

CN 101236728 8/2008
CN 101271208 9/2008
(Continued)

OTHER PUBLICATIONS

Office Action from related Chinese Application No. 201510550060.5 dated Mar. 1, 2017 (11 pages).
(Continued)

*Primary Examiner* — Thuy Pardo
(74) *Attorney, Agent, or Firm* — Harness, Dickey & Pierce, P.L.C.

(57) ABSTRACT

An apparatus for controlling liquid crystal display brightness includes: a zone image grayscale determining section configured to determine grayscale values of pixels in a zone image data block under a predetermined rule according to a received image signal; a zone backlight value pre-obtaining section configured to pre-obtain a zone backlight value corresponding to the zone image data block according to the grayscale values; a zone backlight value gain section configured, when it is determined that the zone backlight value is above a first threshold, to multiply the zone backlight value with a backlight value gain coefficient to obtain a backlight value to which a gain is applied, corresponding to the zone image data block, and to output the backlight value to which the gain is applied, to a driver circuit of backlight source in a backlight zone corresponding to the zone image data block, to control brightness of the backlight source in the corresponding backlight zone as a result of driving, where the backlight value gain coefficient is more than 1; and a zone image grayscale compensating section config-
(Continued)

ured, when it is determined that the zone backlight value is below a second threshold, to compensate for the grayscale values of pixels in the zone image data block using compensation coefficients respectively to obtain compensated image data for driving the liquid crystal panel, wherein the compensation coefficient is more than 1.

18 Claims, 10 Drawing Sheets

(56) References Cited

U.S. PATENT DOCUMENTS

| | | | | |
|---|---|---|---|---|
| 2004/0257329 | A1 | 12/2004 | Park et al. | |
| 2005/0057487 | A1 | 3/2005 | Takata et al. | |
| 2005/0179639 | A1 | 8/2005 | Hsieh | |
| 2007/0001997 | A1 | 1/2007 | Kim et al. | |
| 2007/0030697 | A1 | 2/2007 | Kim | |
| 2007/0216636 | A1* | 9/2007 | Lo | G09G 3/3406 345/102 |
| 2007/0222730 | A1 | 9/2007 | Kao et al. | |
| 2008/0055231 | A1* | 3/2008 | Nose | G09G 3/3406 345/102 |
| 2008/0180383 | A1 | 7/2008 | Lin et al. | |
| 2008/0186393 | A1 | 8/2008 | Lee et al. | |
| 2008/0245949 | A1 | 10/2008 | Morimoto et al. | |
| 2008/0284719 | A1 | 11/2008 | Yoshida | |
| 2009/0066632 | A1 | 3/2009 | Chen | |
| 2009/0128583 | A1 | 5/2009 | Choi | |
| 2009/0167670 | A1* | 7/2009 | Peng | G09G 3/3426 345/102 |
| 2009/0189842 | A1* | 7/2009 | Huang | G09G 3/342 345/102 |
| 2010/0020005 | A1 | 1/2010 | Jung et al. | |
| 2010/0066657 | A1 | 3/2010 | Park et al. | |
| 2010/0103089 | A1 | 4/2010 | Yoshida et al. | |
| 2010/0164922 | A1* | 7/2010 | Nose | G09G 3/3406 345/207 |
| 2010/0245397 | A1* | 9/2010 | Choe | G09G 3/342 345/690 |
| 2011/0051161 | A1 | 3/2011 | Yen et al. | |
| 2011/0205442 | A1 | 8/2011 | Mori et al. | |
| 2011/0292018 | A1 | 12/2011 | Kubota et al. | |
| 2012/0249613 | A1* | 10/2012 | Takada | G09G 3/3406 345/690 |
| 2013/0265337 | A1* | 10/2013 | Furumoto | G09G 5/10 345/690 |
| 2015/0009249 | A1 | 1/2015 | Kudo et al. | |
| 2015/0213781 | A1 | 7/2015 | Huang | |
| 2015/0339967 | A1* | 11/2015 | Shin | G06F 3/1446 345/690 |
| 2016/0035285 | A1* | 2/2016 | Jung | G09G 3/2092 345/207 |
| 2016/0284283 | A1 | 9/2016 | Kurita | |

FOREIGN PATENT DOCUMENTS

| | | | |
|---|---|---|---|
| CN | 101329458 | | 12/2008 |
| CN | 101383139 | | 3/2009 |
| CN | 101388183 | A | 3/2009 |
| CN | 101650921 | | 2/2010 |
| CN | 101673521 | A | 3/2010 |
| CN | 201607919 | U | 10/2010 |
| CN | 102081258 | | 6/2011 |
| CN | 102137178 | A | 7/2011 |
| CN | 102243855 | A | 11/2011 |
| CN | 102292757 | A | 12/2011 |
| CN | 102473383 | | 5/2012 |
| CN | 102568386 | | 7/2012 |
| CN | 102622990 | A | 8/2012 |
| CN | 102890918 | | 1/2013 |
| CN | 103050095 | | 4/2013 |
| CN | 103106875 | A | 5/2013 |
| CN | 103310765 | A | 9/2013 |
| CN | 104050934 | | 9/2014 |
| CN | 104599642 | | 5/2015 |
| DE | 102008004281 | | 8/2008 |
| JP | 2002014660 | | 1/2002 |
| JP | 2008268798 | | 11/2008 |
| KR | 100809073 | | 3/2008 |
| KR | 102011066510 | | 6/2011 |
| WO | WO-2013166994 | A1 | 11/2013 |

OTHER PUBLICATIONS

Office Action from related Chinese Application No. 201510550060.5 dated Aug. 1, 2017 (10 pages).
Office Action from related Chinese Application No. 201510550126.0 dated Mar. 23, 2017 (15 pages).
Office Action from related Chinese Application No. 201510592299.9 dated Apr. 13, 2017 (10 pages).
Office Action from related Chinese Application No. 201510592299.9 dated Oct. 18, 2017 (3 pages).
Office Action from related Chinese Application No. 201510549986.2 dated Mar. 24, 2017 (11 pages).
Office Action from related Chinese Application No. 201510664843.6 dated Feb. 23, 2017 (8 pages).
Office Action from related Chinese Application No. 201510665186.7 dated Mar. 31, 2017 (10 pages).
U.S. Appl. No. 15/185,537, filed Jun. 17, 2016, Yuxin Zhang et al.
U.S. Appl. No. 15/185,682, filed Jun. 17, 2016, Yuxin Zhang et al.
U.S. Appl. No. 15/158,759, filed May 19, 2016, Jia Yang et al.
U.S. Appl. No. 15/158,702, filed May 19, 2016, Yuxin Zhang et al.
U.S. Appl. No. 15/173,667, filed Jun. 5, 2016, Yuxin Zhang et al.
U.S. Appl. No. 15/173,669, filed Jun. 5, 2016, Yuxin Zhang et al.
Office Action from Chinese Application No. 201410267408.5 dated Jul. 10, 2017 (9 pages).
Office Action from Chinese Application No. 201510665186.7 dated Nov. 28, 2017 (5 pages).

* cited by examiner

--Prior Art--

--Prior Art--

--Prior Art--

APPARATUS AND METHOD FOR CONTROLLING LIQUID CRYSTAL DISPLAY BRIGHTNESS, AND LIQUID CRYSTAL DISPLAY DEVICE

CROSS-REFERENCE TO RELATED APPLICATION

This application claims the benefit and priority of Chinese Patent Application No. 201510550065.8 filed Sep. 1, 2015. The entire disclosure of the above application is incorporated herein by reference.

FIELD

This disclosure relates to the field of liquid crystal display technologies and particularly to an apparatus and method for controlling liquid crystal display brightness, and a liquid crystal display device.

BACKGROUND

This section provides background information related to the present disclosure which is not necessarily prior art.

A Liquid Crystal Display (LCD) device typically controls backlight brightness through dynamic backlight modulation to thereby save energy and improve the display contrast and other image quality-of-picture effects. As illustrated in FIG. 1 which is a structural principle diagram of dynamic backlight modulation in the liquid crystal display device in the prior art, the liquid crystal display device includes an image processing component configured to receive an input image signal, and to acquire backlight data as a function of grayscale brightness of the image signal, where on one hand, the image signal is converted in format according to the predetermined specification of a display panel, and output to a timing controller (TCON) in a liquid crystal display component, and a timing control signal and a data signal are generated by the timing controller to drive the liquid crystal panel; and on the other hand, the acquired backlight data are output to a backlight processing component, and the backlight data are converted by the backlight processing component into a backlight control signal to control a backlight driver component to control brightness of backlight sources in a backlight assembly so that if the brightness of the image is high, then the backlight source will be driven for high backlight brightness, and if the brightness of the image is low, then the backlight source will be driven for low backlight brightness.

SUMMARY

This section provides a general summary of the disclosure, and is not a comprehensive disclosure of its full scope or all of its features.

In an aspect, an embodiment of this disclosure provides a method for controlling liquid crystal display brightness, the method including: determining, by a liquid crystal display device, grayscale values of pixels in a zone image data block under a predetermined rule according to a received image signal, and pre-obtaining, by the liquid crystal display device, a zone backlight value corresponding to the zone image data block according to the grayscale values; multiplying, by the liquid crystal display device, the pre-obtained zone backlight value with a backlight value gain coefficient to obtain a backlight value to which a gain is applied, corresponding to the zone image data block, when it is determined that the zone backlight value is above a first threshold, and outputting, by the liquid crystal display device, the backlight value to which the gain is applied, to a driver circuit of backlight source in a backlight zone corresponding to the zone image data block to control brightness of the backlight source in the backlight zones as a result of driving, wherein the backlight value gain coefficient is more than 1; and compensating, by the liquid crystal display device, for grayscale values of pixels in the zone image data block using a compensation coefficient to obtain compensated image data for driving a liquid crystal panel, when it is determined that the zone backlight value is below a second threshold, wherein the compensation coefficient is more than 1.

In another aspect, an embodiment of this disclosure provides an apparatus for controlling liquid crystal display brightness, the apparatus including: a zone image grayscale determining section configured to determine grayscale values of pixels in a zone image data block under a predetermined rule according to a received image signal; a zone backlight value pre-obtaining section configured to pre-obtain zone a backlight value corresponding to the zone image data block according to the grayscale values; a zone backlight value gain section configured, when it is determined that the zone backlight value is above a first threshold, to multiply the pre-obtained zone backlight value with a backlight value gain coefficient to obtain a backlight value to which a gain is applied, corresponding to the zone image data block, and to output the backlight value to which the gain is applied, to a driver circuit of backlight source in a backlight zone corresponding to the zone image data block to control brightness of the backlight source in the backlight zone as a result of driving, where the backlight value gain coefficient is more than 1; and a zone image grayscale compensating section configured, when it is determined that the zone backlight value is below a second threshold, to compensate for grayscale values of pixels in the zone image data block using a compensation coefficient to obtain compensated image data for driving the liquid crystal panel, wherein the compensation coefficient is more than 1.

In a further aspect, an embodiment of this disclosure provides a liquid crystal display device including: a memory configured to store programs and various preset lookup table data; an apparatus for controlling liquid crystal display brightness configured to execute the programs in the memory, and to invoke the various lookup table data according to the executed programs; to receive an image signal, to process the data, and to output the image data to a timing controller so that the timing controller generates a driver signal according to the image data to control a liquid crystal panel to display an image; and to output zone backlight values to a backlight processing unit according to the image signal; the backlight processing unit configured to determine duty ratios of corresponding PWM signals according to the respective zone backlight values, and to output the duty ratios to a PWM driver unit; and the PWM driver unit configured to generate PWM control signals to control backlight sources in image zones; wherein the apparatus for controlling liquid crystal display brightness is any one of aforementioned apparatuses above for controlling liquid crystal display brightness.

In the method and apparatus for controlling liquid crystal display brightness, and the liquid crystal display device, according to some preferred embodiments of this disclosure, in areas of pictures at low brightness, since backlight brightness thereof is not a bottleneck limiting the brightness of the displayed image, the grayscale values of the pixels can be compensated for in these embodiment by compensating for the grayscale values of the respective pixels, and the different grayscale values of the different pixels can be compensated for by different compensation amplitudes, thus improving the difference in brightness between the displayed pictures of the image so as to enhance the sense of hierarchy. A bottleneck limiting display brightness of the image in an area of a picture at high brightness is backlight peak brightness; and if the grayscale values of the pixels in the image are compensated for, then the brightness of the displayed image cannot be improved due to the limited maximum backlight peak brightness, so the backlight peak brightness of the zone will be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of the backlight zone in an area of a picture at high brightness to improve the sense of hierarchy in the picture, so that the overall sense of hierarchy in the image can be improved to thereby improve the effect of the dynamic contrast of the pictures.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Example embodiments will now be described more fully with reference to the accompanying drawings.

Dynamic backlight modulation generally includes zoned backlight modulation and global backlight modulation, where in the global backlight modulation, the backlight brightness is controlled by acquiring the average brightness over one frame of image so that the real backlight brightness is determined by the average grayscale value across the frame of global image, so the maximum average grayscale value over the image (i.e., the all-white image) corresponds to the maximized backlight brightness, and in order to guarantee the reliability of the backlight source in operation, the maximized backlight brightness is typically controlled below rated brightness of the backlight source in operation. Typically in a normally displayed picture, the average grayscale brightness across the entire dynamic video picture can be statistically known at around 50% IRE, so that the average value of the backlight brightness will be around 50% of the maximized backlight brightness. Thus the real average power of the backlight source operating with global backlight modulation is controlled around half of the rated power, and there is some apparent effect of saving energy. However in global backlight modulation, the average grayscale brightness across one or more consecutive frames of image is acquired, and global backlight source brightness is controlled by the average grayscale brightness of the image (s), but the average grayscale brightness of the image(s) may not reflect brightness details between local pictures of the images, and a variation in contrast of the image(s) will be more reflected in the difference in brightness between the local pictures of the images, and thus may not significantly improve the quality-of-picture effect for the display contrast.

Figure 1:
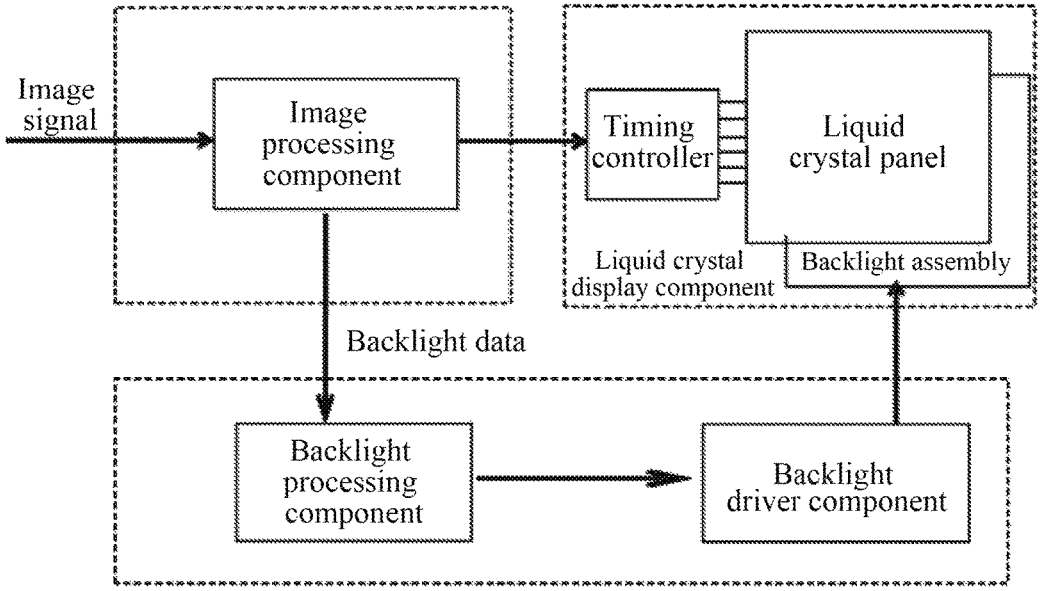
FIG. 1 is a structural principle diagram of dynamic backlight modulation in the liquid crystal display device in the prior art.
Figure 2:
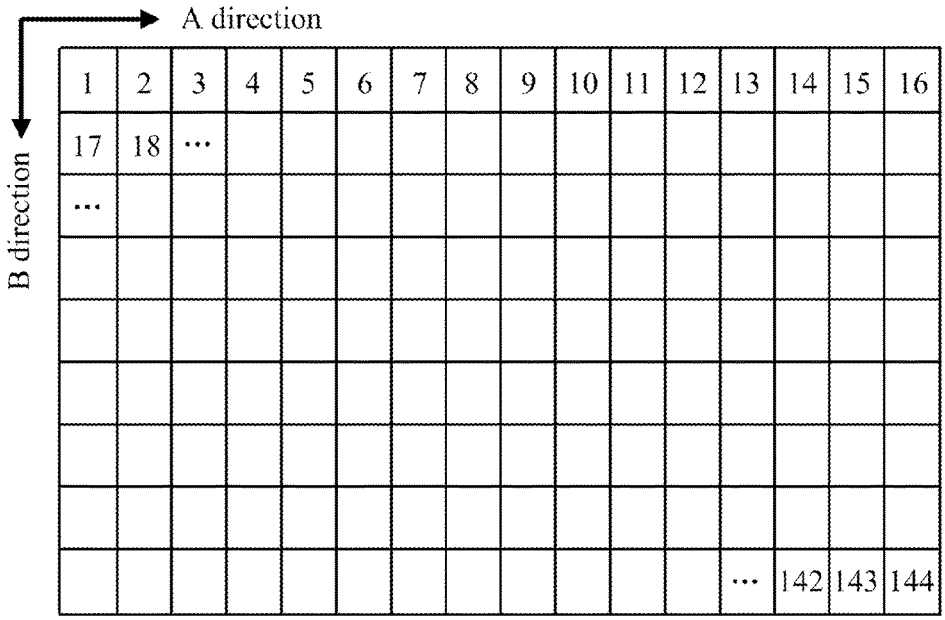
FIG. 2 is a schematic diagram of backlight zones in zoned dynamic backlight modulation in the prior art.

Zoned dynamic backlight modulation will be described as follows. As illustrated in FIG. 2 which is a schematic diagram of backlight zones in zoned dynamic backlight modulation in the prior art, the entire matrix of backlight sources includes M zones in the direction A and N zones in the direction B, and as illustrated, if M=16 and N=9, then there will be M*N=144 backlight zones in total, in each of which the backlight source brightness can be controlled separately as a result of driving, where it shall be noted that ideally the respective backlight zones can illuminate their backlight areas separately, but in fact, the brightness of the adjacent backlight sources may be affected somewhat. In zoned dynamic backlight modulation, each frame of global image is segmented into a number of zone image data blocks corresponding to the backlight zones, and grayscale data in the respective zone image data blocks are acquired to obtain the backlight data of the corresponding backlight zones, and the obtained backlight data of the respective zones reflect the differences in brightness between the corresponding zone image data blocks, so that the backlight brightness of the backlight zones will be determined by the brightness of the image data blocks corresponding to the backlight zones, and the variations in backlight brightness of the zones will reflect the grayscale brightness in the zone image data blocks in which area pictures need to be displayed, and highlight the differences in display brightness between the local pictures of the displayed image, thus improving the contrast quality-of-picture effect of the dynamic picture.

In order to improve the effect of a dynamic contrast quality-of-picture of a displayed image in a liquid crystal display device, zoned dynamic backlight modulation is applied so that the entire matrix of backlight sources thereof is divided into a number of backlight zones in row and column directions, and the backlight sources in each backlight zone can be driven separately to drive brightness thereof, where it shall be noted that ideally the respective backlight zones can illuminate separately their backlight zones, but in fact, the brightness of the adjacent backlight sources may be affected somewhat. Image grayscale brightness of zone image data blocks displayed on a liquid crystal display panel corresponding to the backlight zones is acquired, backlight values of the backlight zones are obtained as a function of the image grayscale brightness in an algorithm of obtaining the backlight values, and the backlight sources in the zones are driven by the backlight values to emit light so as to provide desirable backlight brightness for the image in the zones to be displayed. It shall be noted that the zone image data blocks refer to aggregation of image data of all the pixels displayed in display zones of the liquid crystal panel at the same positions as the backlight zones, where the display zones of the liquid crystal display panel is obtained by zoning the liquid crystal display panel uniformly under the same zoning rule as the backlight zones, where the backlight zones may not overlap completely with the boundaries of the areas displayed on the liquid crystal panel corresponding to the zone image data blocks due to a design error and a process error, or taking into account of other factors, such as design demand, and it shall be further noted that the backlight zones, and the zones of the liquid crystal panel relate to virtual boundaries instead of physical boundaries in a real design.

Figure 3:
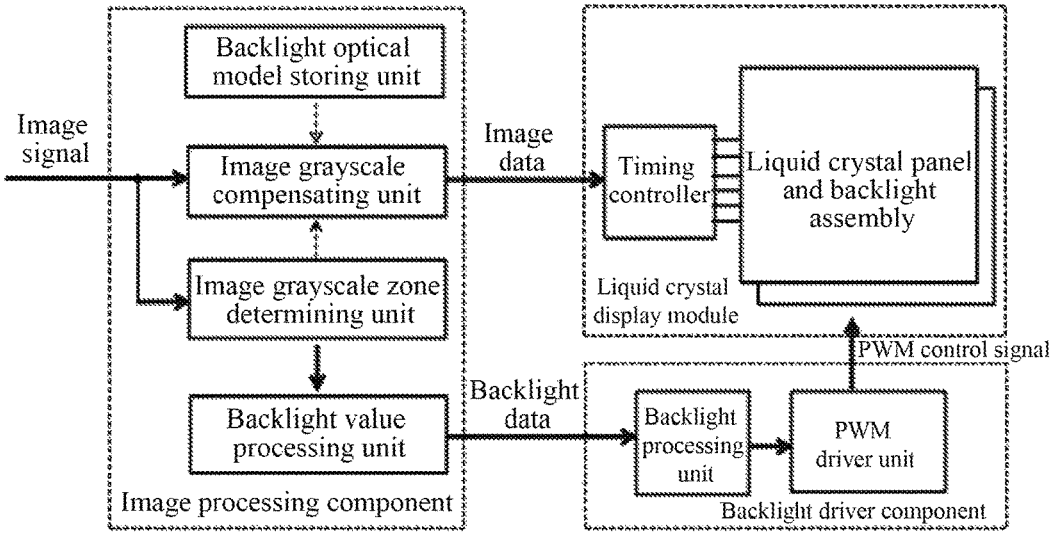
FIG. 3 is a structural diagram of obtaining the backlight values of the zones in zoned dynamic backlight modulation in the prior art.

In the prior art, the backlight values of the backlight data of the image are acquired in zoned dynamic backlight modulation as follows: as illustrated in FIG. 3, an image processing component receives an input image signal, and on one hand, an image grayscale zone determining unit is configured to determine a brightness grayscale of each image pixel in a zone image data block in the image signal, and a backlight value processing unit is configured to obtain a backlight value of the zone from a determination result, where the backlight value can be obtained particularly as the maximum value, the average value, the average value of weighted values, the weighted value of average values, etc.; and on the other hand, in order to compensate for a difference in display brightness of the image arising from different backlight brightness in the different backlight zones, an image grayscale compensating unit can further perform a predetermined image data grayscale compensation algorithm on the backlight value in each backlight zone according to a preset function relationship in a backlight optical model storing unit, and obtain and output compensated image data to a timing controller to drive the liquid crystal panel to display the image. Particularly in the algorithm above for obtaining the backlight value, for example, if the image grayscale of each image pixel ranges from 0 to 255, then the backlight value of the zone will be obtained as any one value from 0 to 255; and then a backlight processing unit receives and then converts directly the any one backlight value from 0 to 255 into a PWM backlight drive signal to drive the backlight sources in the zone, where the backlight source is driven by the maximum backlight value of 255 accordingly for the maximum backlight brightness, and the backlight source is driven by any other backlight value between 0 and 255 for lower peak brightness than the maximum backlight brightness. As can be known from an analysis thereof, the index of picture contrast is determined by ration of the maximum peak brightness and the minimum display brightness, i.e., the ratio of display brightness of a picture at the display grayscale value of 255 to display brightness of a picture at the display grayscale value of 0, but the brightness of the picture at the display grayscale value of 0 is typically predetermined and hardly influenced by the backlight brightness, so the maximum peak brightness is a predominating factor of the index of displayed picture contrast. As can be known from the analysis above, if the maximum peak brightness of the respective zones is limited to the maximum backlight value of 255, then an improvement to the contrast of the displayed picture may be discouraged.

In order to address the limited algorithm in which the backlight values are obtained in the prior art, so as to further improve the effect of the contrast quality of picture in the image displayed by the liquid crystal display device using dynamic backlight control on the zones, this disclosure proposes a method and apparatus for controlling liquid crystal display brightness, and a liquid crystal display device.

All the embodiments of this disclosure relate to an 8-bit ($2^8$=256 grayscales) liquid crystal display screen by way of an example.

Figure 4:
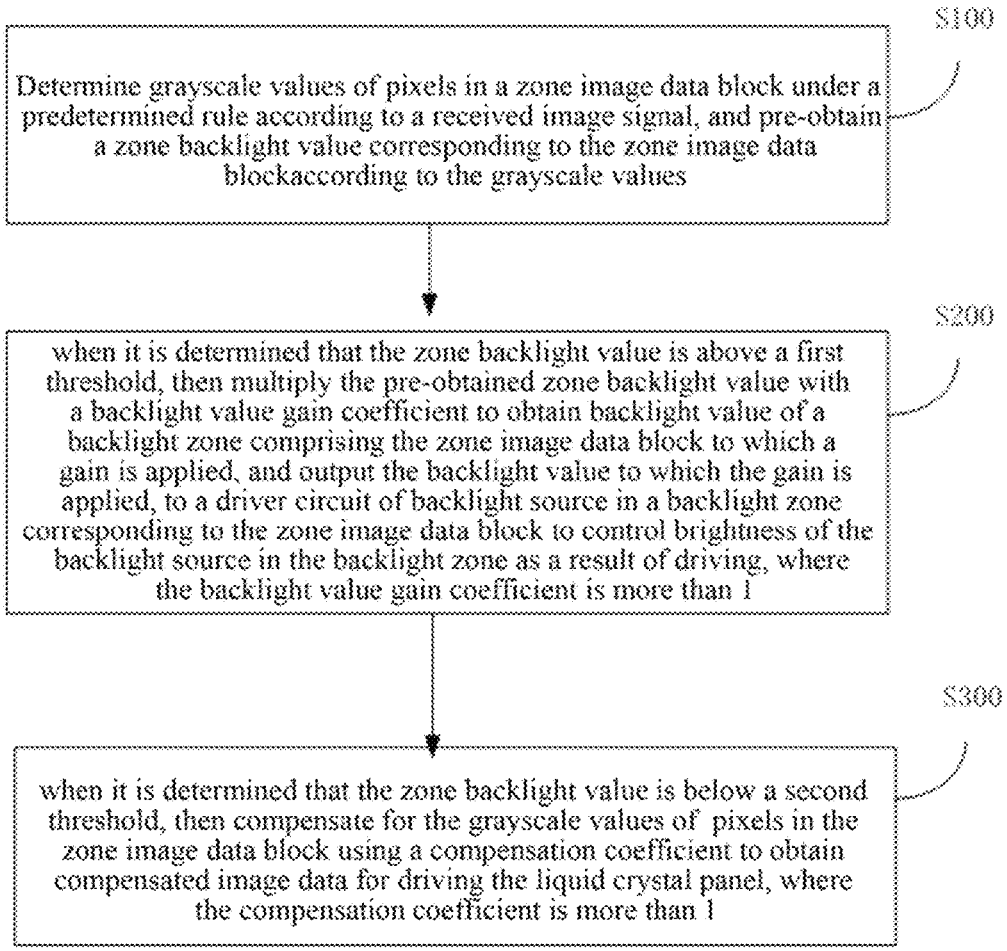
FIG. 4 is a schematic flow chart of a method for controlling liquid crystal display brightness according to a first embodiment of this disclosure.

A first embodiment of this disclosure provides a method for controlling liquid crystal display brightness. FIG. 4 is a schematic flow chart of a method for controlling liquid crystal display brightness according to the first embodiment of this disclosure. An executor of this embodiment can be an image processing device in which processing and storing functions are integrated. The image processing device can be a single video processing chip, or consisted of a number of video processing chips cooperating with each other, and can be arranged in a liquid crystal display device with control technique of zoned dynamic backlight, where the liquid crystal display device can be a liquid crystal TV set, a liquid crystal display, a tablet computer, etc.; and with this method, backlight values for driving brightness of backlight sources in respective backlight zones are generated for an input image signal to improve the effect of display contrast of the image as a whole, and the method for controlling liquid crystal display brightness includes:

The step S100 is to determine image grayscale values in a zone image data block under a predetermined rule according to a received image signal, and to pre-obtain zone a backlight value corresponding to the zone image data block according to the image grayscale values.

In this embodiment, the predetermined rule can be a pre-stored function model in which a liquid crystal panel is divided into a number of virtual zones at the same proportion as the backlight zones, and image data of all the pixels displayed in one of the virtual zones are aggregated to form a zone image data block.

The zone backlight value of each zone image data block can be pre-obtained from the grayscale values of respective pixels in each of the zones in a preset algorithm, where the pre-obtained zone backlight value is not finally used to drive the backlight sources, but a gain will be further applied to the pre-obtained zone backlight value and/or the pre-obtained zone backlight value will be adjusted, thus resulting in a final backlight value.

It shall be noted that the preset algorithm can be an algorithm of averaging the grayscales of all the pixels, or can be an algorithm of averaging the maximum values of red, green, and blue sub-pixels in the respective pixels, or can be an algorithm of averaging their weighted grayscales, where weight coefficients thereof can be preset; and those skilled in the art can devise other particular algorithms of obtaining the backlight values without any inventive effort, and the backlight data of the zones can be obtained in alternative algorithms in this embodiment and other embodiments, so the embodiments of the invention will not be limited thereto.

By way of an example, the matrix of backlight sources in the liquid crystal display panel is divided into 16 zones in the row direction and 9 zones in the column direction, so that the entire matrix of backlight sources are divided into 144 backlight zones, in each of which the backlight sources can be driven separately to control brightness, where the brightness can be controlled through current or PWM-controlling, and the backlight sources can be LED backlight sources. The resolution of the liquid crystal display panel in the liquid crystal display device is 3840*2160, and accordingly there are 16*9 virtual zones on the liquid crystal display panel under a backlight zoning rule. As per the positions where the virtual zones of the image data on the liquid crystal display panel are displayed, the image data are segmented into 16*9 zone image data blocks according to the predetermined function model, where each zone image data block includes 240*240 pixels, so the 240*240 pixels in each zone image data block are displayed on one virtual zone of the display panel at display brightness controlled by the backlight sources in the corresponding backlight zone. Then grayscale values of the 240*240 pixels in the one zone image data block are determined, the average of the grayscale values of the zone image data block is obtained as 160 in the predetermined backlight algorithm, and the pre-obtained zone backlight value of the corresponding backlight zone is obtained as 160; and the pre-obtained zone backlight values of the other backlight zones are obtained similarly.

It shall be noted that the backlight zone may not overlap completely with the boundary of the area displayed on the liquid crystal panel corresponding to the zone image data block due to a design error and a process error, or taking into account of a design demand and other factors, that is, the real number of pixels in the zone image data block may be more than 240*240, so that there may be pixels overlapping between the adjacent zone image data blocks.

The step S200 is, when it is determined that the zone backlight value is above a first threshold, to multiply the pre-obtained zone backlight value with a backlight value gain coefficient to obtain a backlight value to which a gain is applied, corresponding to the zone image data block, and to output the backlight value to which the gain is applied, to a driver circuit of backlight source in a backlight zone corresponding to the zone image data block to control brightness of the backlight source in the backlight zone as a result of driving, where the preset backlight value gain coefficient is more than 1.

In this first embodiment, it is determined whether the backlight value of the respective zones is above the first threshold, and if so, which indicates brighter pictures of the image in the zones, then the gain will be applied to the backlight values to thereby improve the sense of hierarchy in the displayed pictures of the zones. The pre-obtained zone backlight value can be multiplied with the backlight value gain coefficient to obtain the backlight value to which the gain is applied, corresponding to the zone image data block, where the backlight value gain coefficient is more than 1.

In this embodiment, the zone backlight values of the respective backlight zones are pre-obtained respectively as in the step S100 in which the zone backlight values are pre-obtained, and then the zone backlight values are multiplied respectively with a backlight value gain coefficient to obtain the backlight values of the respective backlight zones to which the gain is applied. Since the preset backlight value gain coefficient is more than 1, then the backlight values of the respective backlight zones to which the gain is applied, as a result of the multiplication are more than the pre-obtained zone backlight values, so that if the backlight of the zones is driven using the backlight values to which the gain is applied, then the peak brightness will be improved, and as can be apparent from the analysis in the Background section, the improvement of the peak brightness in the zones can enhance the contrast of the displayed pictures of the image.

It shall be noted that those skilled in the art can select the particular value of the preset backlight gain coefficient as needed for the design, for example, if the backlight gain coefficient is taken as 1.5, then each zone backlight value will be pre-obtained and multiplied respectively with the backlight gain coefficient of 1.5, or if the backlight gain coefficient is taken as 2, then each zone backlight value will be pre-obtained and multiplied respectively with the backlight gain coefficient of 2. In order to ensure the reliability of the backlight sources being lightened, it will not be appropriate for the amplitude of the gain to be too large, and the parameter can be selected by those skilled in the art without any inventive effort.

By way of an example, as in the step S100, a zone backlight value is pre-obtained as 160 in a backlight zone, and multiplied with the backlight value gain coefficient of 2 to obtain the backlight value of the zone, to which the gain is applied, as 320, so that the backlight value to which the gain is applied can be improved significantly, and the peak brightness of the backlight zone can be improved significantly by driving the backlight sources of the backlight zone using the backlight value to which the gain is applied, thus enhancing the effect of the contrast quality of picture.

In this embodiment, the preset backlight value gain coefficient can be some defined value more than 1 for all the image frames, so that the backlight value gain coefficient will be the same for the backlight value of each zone in a picture of a frame of image, and also the same for different frames of images, so the same backlight value gain coefficient will apply to all the backlight zones in all the frames of images.

Figure 6:
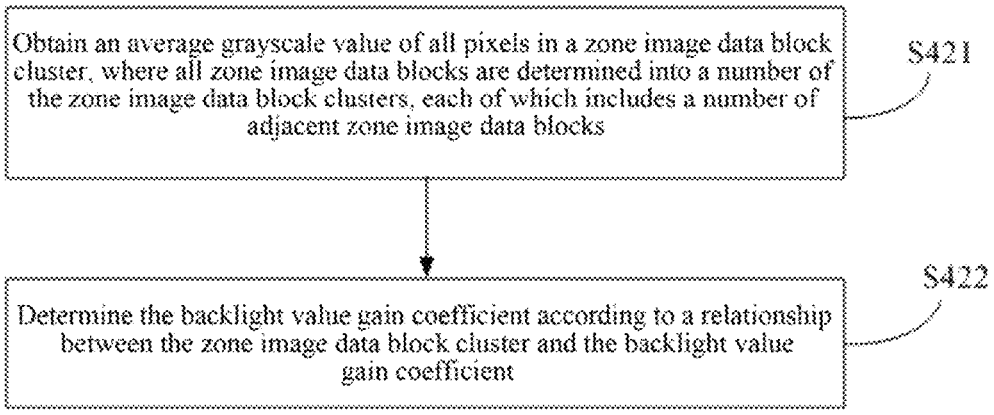
FIG. 6 is a schematic flow chart of obtaining a backlight gain coefficient according to the first embodiment of this disclosure.

Furthermore in another embodiment of this disclosure, the preset backlight gain coefficient can be obtained particularly by presetting a lookup table. As illustrated in FIG. 6 which is a schematic flow chart of a method for obtaining a preset backlight gain coefficient according to the first embodiment of this disclosure, the flow particularly includes:

The step S421 is to obtain an average grayscale value of all pixels in a zone image data block cluster, where all zone image data blocks are determined into a number of the zone image data block clusters, each of which includes a number of adjacent zone image data blocks.

By way of an example, as illustrated in FIG. 2, the entire matrix of backlight sources is divided into 16*9=144 backlight zones under the backlight zoning rule where there are 16 zones in the row direction and 9 zones in the column direction. The display area of the display panel is divided correspondingly into 16*9=144 virtual zones under the backlight zoning rule, where a zone image data block includes display image data aggregated in each virtual zone of the display panel, so a frame of image data is segmented correspondingly into 16*9=144 zone image data blocks.

Figure 5A:
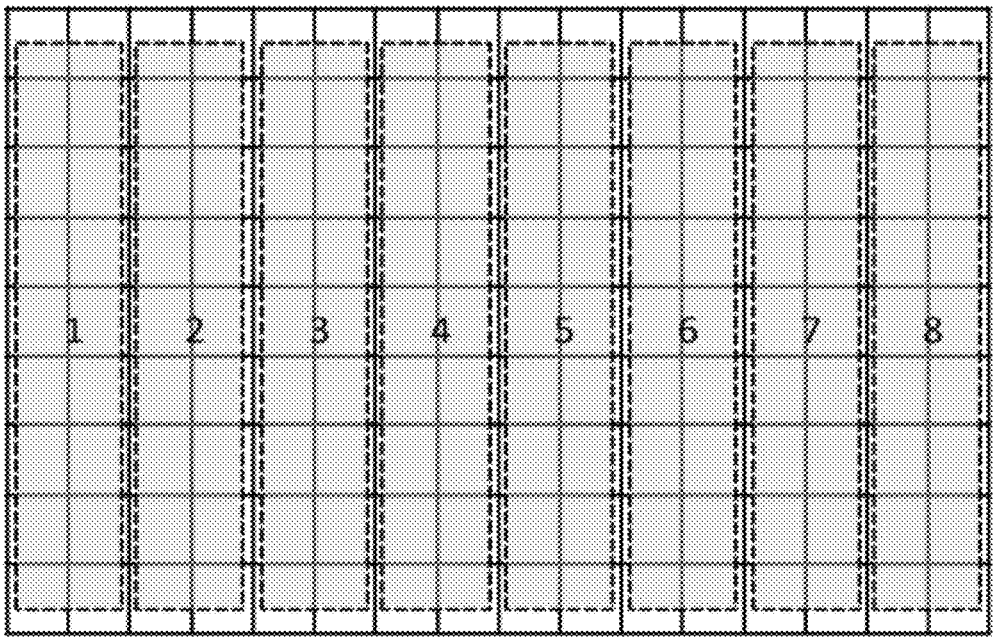
FIG. 5A is a schematic diagram of clusters into which zone image data blocks are segmented according to the first embodiment of this disclosure.
Figure 5B:
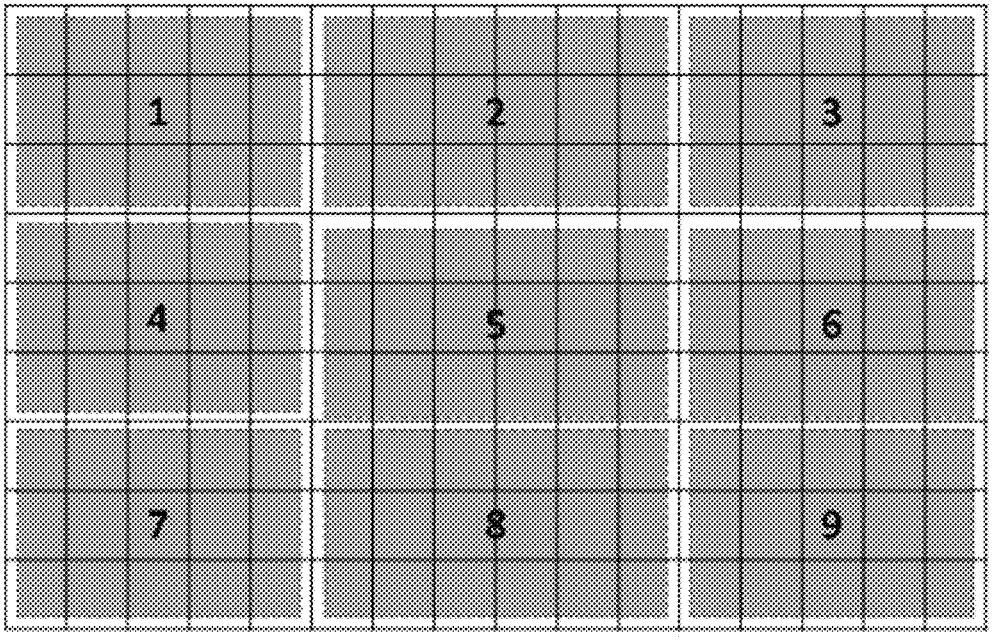
FIG. 5B is another schematic diagram of clusters into which zone image data blocks are segmented according to the first embodiment of this disclosure.
Figure 9:
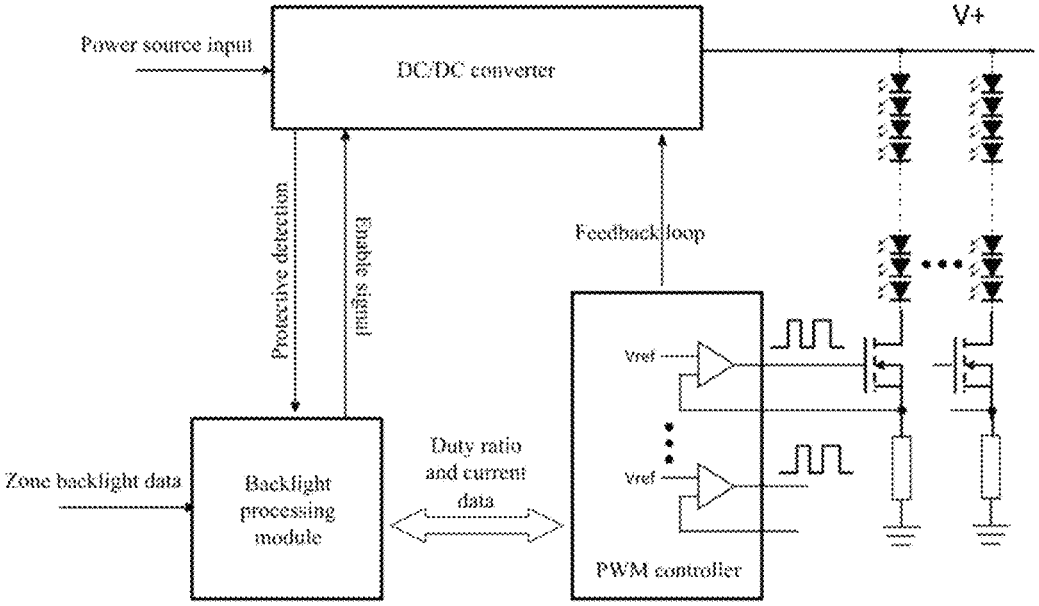
FIG. 9 is a structural diagram of drivers in backlight sources according to the first embodiment of this disclosure.

As illustrated in FIG. 5A which is a schematic diagram of clusters into which zone image data blocks are segmented according to the first embodiment of this disclosure, where every two columns are a zone image data block cluster, and each zone image data block cluster includes 2*9=18 zone image data blocks, thus resulting in 8 zone image data block clusters in total. It shall be noted that a zone image data block cluster refers to aggregated data of all the pixels in a number of adjacent zone image data blocks. The zone image data blocks are divided into the clusters under a rule which can be determined as required for the design, for example, they are evenly divided into 8 clusters in the column direction as illustrated in FIG. 5A, or 9 clusters in both the row direction and the column direction as illustrated in FIG. 5B.

Grayscale values of all pixels in each zone image data block cluster is obtained respectively, and then the average grayscale value is obtained in a preset algorithm which can be an algorithm of averaging the grayscales of all the pixels, or an algorithm of averaging the maximum values of red, green, and blue sub-pixels in the respective pixels, or an algorithm of averaging their weighted grayscales, where weight coefficients thereof can be preset; and those skilled in the art can devise other particular algorithms of obtaining the backlight values without any inventive effort, and the backlight data of the zones can be obtained in alternative algorithms in this embodiment and other embodiments, so the embodiments of the invention will not be limited thereto.

It shall be noted that in the preset algorithm, the average grayscale values of the respective zone image data blocks can be obtained firstly according to the step S100, and then the average grayscale values of a zone image data block cluster can be obtained according to the average grayscale values of the respective zone image data blocks.

Stated otherwise, firstly the grayscale values of all pixels in each zone image data block cluster are obtained, and then the average grayscale value of each zone image data block cluster are obtained according to the grayscale values of all the pixels in the preset algorithm.

The step S422 is to determine the backlight value gain coefficient according to a relationship between the zone image data block cluster and the backlight value gain coefficient.

A backlight value gain coefficient lookup table can be pre-stored in which the correspondence relationship between the average grayscale value of the image and the backlight value gain coefficient, and the average grayscale value of the image is mapped to the gain coefficient, where there are 256 grayscale values in total from 0 to 255 on the transverse axis, and each grayscale value corresponds respectively to a backlight value gain coefficient. The lookup table is searched for the backlight value gain coefficient corresponding to the average grayscale value of the image using the average grayscale value of the image.

Figure 7A:
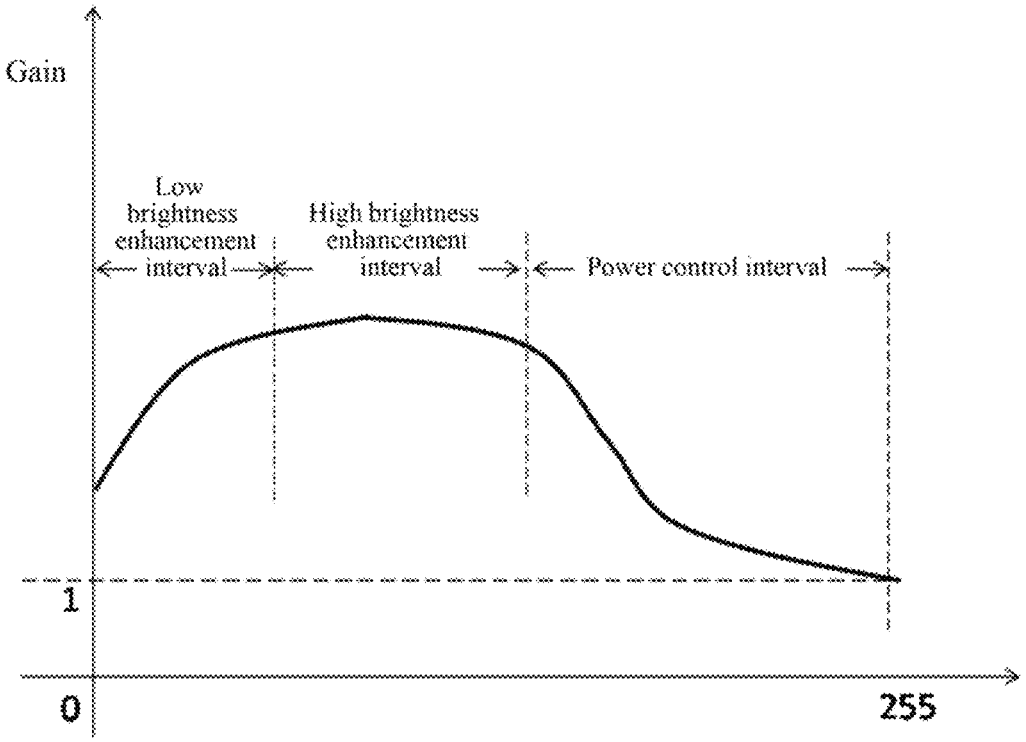
FIG. 7A is a schematic diagram of a backlight value gain curve according to the first embodiment of this disclosure.
Figure 7B:
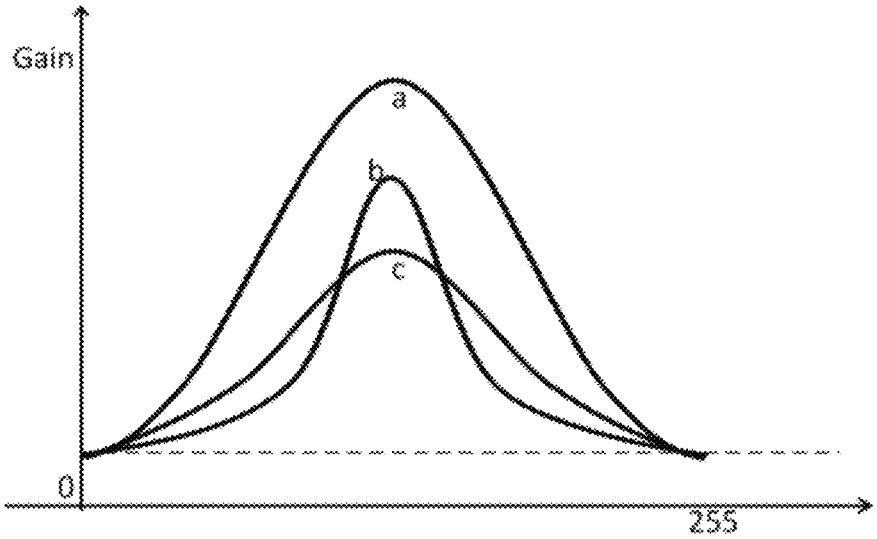
FIG. 7B is a schematic diagram of another backlight value gain curve according to the first embodiment of this disclosure.

By way of an example, as illustrated in FIG. 7B which is a schematic diagram of a backlight value gain curve according to the first embodiment of this disclosure, there are a number of gain curves in FIG. 7*b*, where a zone image data block cluster corresponds to a gain curve, and there are at least two zone image data block clusters corresponding to different gain curves. A gain coefficient lookup table is matched to the position where the zone image data block cluster is distributed on the display area, and referring to FIG. 5A, the zone image data block clusters 1 and 8 correspond to the gain curve c, the zone image data block clusters 2 and 7 correspond to the gain curve b, and the zone image data block clusters 3, 4, 5 and 6 correspond to the gain curve a; and further referring to FIG. 5B, the zone image data block clusters 1, 3, 7 and 9 correspond to the gain curve c, the zone image data block clusters 2, 4, 6 and 8 correspond to the gain curve b, and the zone image data block cluster 5 corresponds to the gain curve a.

As illustrated in FIG. 7B, the gain curves a, b and c are recorded respectively in the different lookup tables to represent different relationships between the backlight gain coefficient and the average grayscale value of the image, where the intermediate brightness gain coefficient in the gain curve a is larger than in the gain curves b and c, and the intermediate brightness gain coefficient in the gain curve b is larger than in the gain curve c. In other words, the general center of an angle of view at which a user is watching a displayed picture is positioned at the center of the displayed image, and the details of the displayed image, and the display focus are located at the center of the display area in order to highlight the effect of the contrast of the picture in the central area, so that a gain curve with a larger gain amplitude, e.g., the gain curve a, will be applied to a zone image data block cluster located in the central area of the displayed image, and a gain curve with a smaller gain amplitude, e.g., the gain curve b or c, will be applied to a zone image data block cluster located remote from the central area of the displayed image.

As illustrated in FIG. 7B, the respective gain curves are varying in the same trend as in FIG. 7A, where each gain curve can be divided into a low brightness enhancement interval, a high brightness enhancement interval, and a power control interval while the average grayscale value of the image is increasing, where the gain coefficient in the high brightness enhancement interval is more than those in the low brightness enhancement interval and the power control interval respectively (not illustrated in FIG. 7B and particularly referring to FIG. 7A). If the grayscale brightness is low, e.g., the average grayscale value ranges from 0 to 100, then it will lie in the low brightness enhancement interval, and the gain coefficient will increase with the increasing grayscale brightness, where if the grayscale brightness is low, then the gain coefficient will approach 1, and the amplitude of the backlight value gain will be low; and as the grayscale brightness is increasing, the gain coefficient will be increasing, and the amplitude of the backlight value gain will also be increasing. If the grayscale brightness is further increasing, for example, the average grayscale value ranges from 10 to 200, then it will lie in the high brightness gain interval; and since the corresponding grayscale brightness of the image in the high brightness gain interval is intermediate, there will be a lot of hierarchal details of the image, and the amplitude of the gain will be large, thus highlighting the sense of hierarchy in the pictures, where the maximum value of the gain coefficient lies in the high brightness gain interval. The particular parameters for the position of the maximum value of the gain coefficient on the curve, and the particular data thereof can be selected by those skilled in the art without any inventive effort. If the brightness of the grayscale brightness in the area is very high, for example, the average grayscale value ranges from 200 to 255, then since the overall brightness of the image in the area is high, the brightness of the image is substantially saturated, the details of the image become less, and the brightness of the entire pictures in the backlight area is sufficiently high, so that human eyes become less sensitive to the high brightness of the image in this area, and thus it will be substantially unnecessary to further enhance the brightness of backlight, and on the contrary, power consumption will be controlled by lowering the amplitude of the backlight gain. Accordingly the gain coefficient will become less while the average grayscale value is further increasing.

It shall be noted that in this embodiment, the backlight value gain coefficient corresponds to the average grayscale value of all the pixels in the area covered by each cluster zone image data block cluster in a one-to-one manner, and the average grayscale value of all the pixels in the area of a frame is uniquely determined in the preset algorithm, where the determined average grayscale value corresponds to a determined backlight gain coefficient. While a frame of pictures are being displayed, all the backlight values of the respective zones in the same zone image data block cluster are multiplied with the same backlight value gain coefficient. However the different zone image data block clusters can correspond to different backlight value gain coefficients, and the different backlight gain coefficients will result in different gain amplitudes of backlight brightness, so that different gain amplitudes of backlight will be generated as a function of the changing image to thereby improve the dynamic contrast of the displayed pictures and control the power consumption of the backlight sources.

It shall be noted in the this first embodiment, in order to improve the peak brightness in the backlight zones, the same frame of pictures can be displayed by applying the backlight gain only to the backlight zones with the zone backlight values above the first threshold to thereby address the problem of poor presentation of the peak brightness of the entire image due to insufficient peak brightness in the backlight zones.

For the sake of a comparative description, if all the backlight values in the respective backlight zones are multiplied with the same gain coefficient for backlight scanning of a frame of pictures being displayed, then the backlight brightness corresponding to a brighter local area in the picture of the image can be enhanced, but also the backlight brightness corresponding to a darker local area in the picture of the image can be enhanced at the same proportion, for example, the backlight brightness in a darker area of a black picture can become higher as a whole, so that if the dark area of the picture is improved in backlight brightness, then the part of the image at lower brightness may come with the phenomenon of "floating black". By way of an example, the display brightness corresponding to a black image at the grayscale of 0 is typically controlled around 0.1 to 0.3 nit, i.e., reference black, so that if the backlight brightness in the black picture is improved, then the display brightness of the reference black will be far higher than 0.1 to 0.3 nit, that is, the picture in the reference black may be distorted in brightness. Since human eyes are sensitive to the appearing black picture, the distortion in brightness of the black picture will be a factor influencing the effect of the contrast quality of picture.

Furthermore in some embodiments of this disclosure, FIG. 9 is a structural diagram of the backlight source driver in the first embodiment of this disclosure, the backlight processing unit outputs the respective zone backlight values to which the gain is applied, to the driver circuits of the backlight sources in the respective zones, and determines duty ratios of corresponding PWM signals according to the backlight data of the respective zones, where if the backlight data are a brightness value ranging from 0 to 255, then the duty ratio of the PWM signal will become larger as the brightness value is increasing, and the backlight processing unit sends the determined duty ratios of the PWM signals to PWM controllers corresponding to the real backlight elements, and the PWM controllers output control signals as a function of the duty ratios to the real backlight elements to control MOS transistors connected with strings of LED lamps to be switched on and off so as to control the real backlight elements to generate brightness corresponding to the backlight data. When the PWM controllers control the real backlight elements according to the PWM duty ratios to generate the brightness corresponding to the backlight data, the amplitudes of the PWM signals can be a preset value, that is, preset current is output in reality.

In other embodiments of this disclosure, the backlight processing module can further send current data in advance to the PWM controllers, and the PWM controllers can adjust the real output current according to the current data and preset reference voltage to thereby control the real backlight elements to generate the brightness corresponding to the backlight data, where there is higher backlight brightness corresponding to larger output current given a duty ratio. The real output current Iout=(current data/Imax)×(Vref/Rs), where Vref represents the preset reference voltage, e.g., 500 mV, and Rs represents the resistance of a current sampling resistor below an MOS transistor, e.g., 1Ω. The current data are typically set by operating registers in the PWM controller, and if the bit width of the register is 10 bit, then Imax=1024 in the equation above, so the current data can be calculated as a function of Tout required in reality. For example, if current of 250 mA is required, then the current data will be set 512 in the equation above. The PWM controllers typically include a number of cascaded chips, each of which can further drive a number of PWM signals to be output to the strings of LED lamps.

It shall be noted that as illustrated in FIG. 9, a DC/DC converter is configured to convert voltage output by a power source into voltage required for a string of LED lamps, and to maintain the stable voltage as a function of a feedback from a feedback circuit. The backlight processing module can be detected for protection, where the backlight processing module can send an enable signal to the DC-DC converter after being started into operation so that the DC/DC converter starts to detect the backlight processing module for protection from over-voltage or over-current.

The step S300 is, if it is determined that the zone backlight value is below a second threshold, to compensate for the grayscale values of the pixels of the image in each of the zone image data blocks using a preset compensation coefficient to obtain compensated image data for driving the liquid crystal panel, where the compensation coefficient is more than 1.

In this first embodiment, if the zone backlight value is below the second threshold, which indicates dark pictures of the image in the zones, then the image will be compensated for to thereby improve the sense of hierarchy in the displayed pictures of the zones. The grayscale values of the image pixels in each of the zone image data blocks are compensated for in grayscale using the preset compensation coefficient more than 1.

In this embodiment, the image grayscale compensation coefficient lookup table can be pre-stored, and searched for the grayscale compensation coefficient using the grayscale value in the zone image data block, where the correspondence relationship between the grayscale value of the image and the compensation coefficient is recorded in the grayscale compensation coefficient lookup table. Here the grayscale value of the image corresponds to the compensation coefficient in a one-to-one manner in the correspondence relationship, and different image grayscale values correspond to different compensation coefficients. In order to alleviate the problem of the lost details in the picture at low brightness, if the zone backlight value is so small that it is below the second threshold, then the compensation coefficient will be more than 1, and the grayscale brightness of the respective pixels in the backlight zone of the picture at low brightness can be compensated for respectively so that there will be a sense of hierarchal display brightness between the respective pixels in the zone to thereby alleviate the problem of the lost details in the picture at low brightness.

By way of an example, for example, the black image at the grayscale value of 0 in "reference black" is multiplied with the compensation coefficient larger than 1 to obtain the compensated image which still is a black image at the grayscale value of 0, thus eliminating the problem of "floating black" of "reference black"; and the image at a higher grayscale value than "reference black", e.g., an image at low brightness at the grayscale of 6, is multiplied with the compensation coefficient larger than 2 to obtain an image at low brightness at the grayscale of 12, thus improving the sense of hierarchal brightness between the image at low brightness and the reference black.

In this embodiment, in order to address the problem of the insufficient sense of presented hierarchy in the picture at low brightness, the grayscale values of the respective pixels in the image in the display area of the picture at low brightness are enhanced respectively for compensation to thereby enhance the sense of hierarchy between the respective pixels of the image, and the sense of hierarchical display brightness is improved due to the backlight gain in the area of the picture at high brightness, so that there will be a strong hierarchy of displayed details of the global image. Stated otherwise, the grayscales of the respective pixels in the same frame of displayed pictures can be compensated for to thereby guarantee the sense of hierarchy in the areas of the pictures at low brightness, and the gain can be applied to the backlight peak brightness to thereby guarantee the sense of hierarchy in the areas of the pictures at high brightness, so that the sense of hierarchy in the pictures can be improved as a whole.

It shall be noted that as can be apparent from the analysis above in this first embodiment, if the gain is applied to the backlight in the area of the picture at low brightness, then the problem of "floating black" will come therewith, and since the backlight brightness thereof is not a bottleneck limiting the contrast of the picture, the grayscale values of the pixels can be compensated for in this embodiment by compensating for the grayscale values of the respective pixels so that the different grayscale values of the different pixels are compensated for by different compensation amplitudes, thus improving the difference in brightness between the displayed pictures of the image so as to enhance the sense of hierarchy. A bottleneck limiting the contrast of the picture in the area of the picture at high brightness is insufficient backlight peak brightness; and if the grayscale values of the pixels in the image are compensated for, then the brightness of the displayed image cannot be improved due to the limited maximum backlight peak brightness, so the backlight peak brightness will be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of a backlight zone in an area of a picture at high brightness to improve the sense of hierarchy in the picture, so that the overall sense of hierarchy in the image can be improved to thereby improve the effect of the dynamic contrast of the pictures.

The grayscale compensation coefficient can be obtained as follows:

The step S61 is to determine a grayscale compensation coefficient lookup table corresponding to each of zone image data block clusters.

A number of compensation coefficient lookup tables are preset, and there are at least two zone image data block clusters corresponding to different lookup tables in which different relationships between a compensation coefficient and a grayscale value are recorded.

Figure 8A:
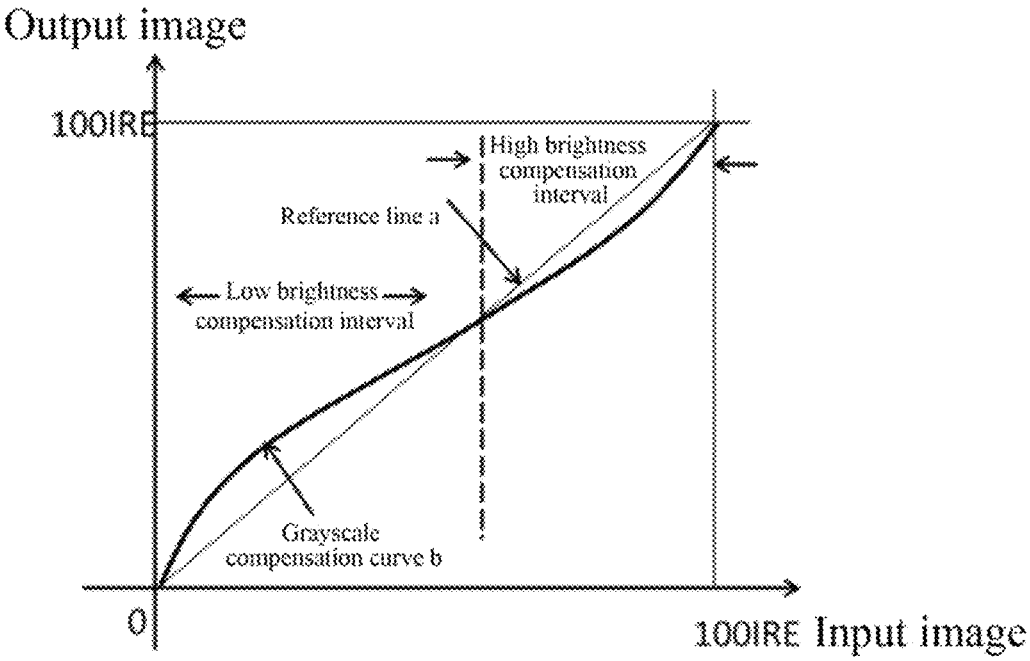
FIG. 8A is a schematic diagram of the image grayscale compensation curve according to the first embodiment of this disclosure.
Figure 8B:
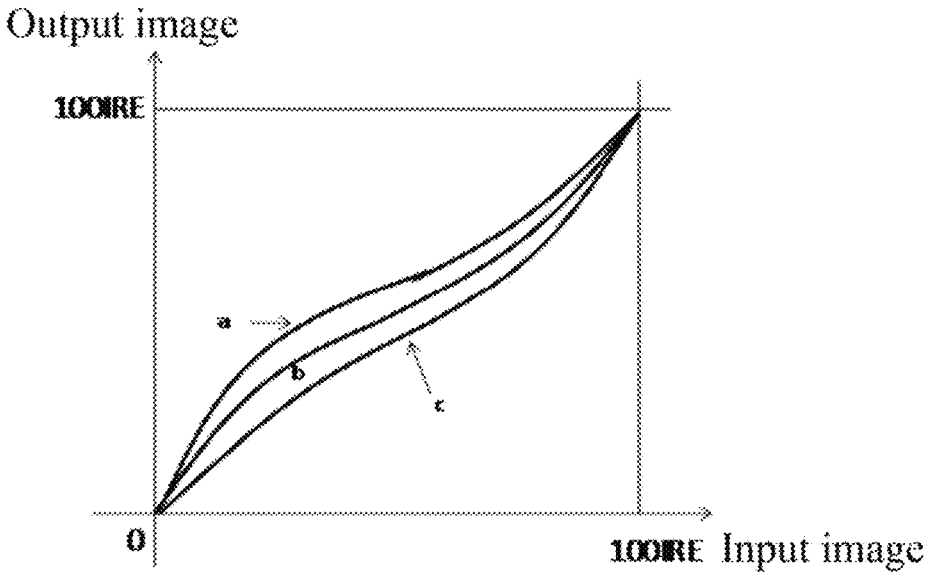
FIG. 8B is a schematic diagram of another image grayscale compensation curve according to the first embodiment of this disclosure.

By way of an example, as illustrated in FIG. 8B which is a schematic diagram of a grayscale compensation curve according to an embodiment of this disclosure, there are a number of grayscale compensation curves in FIG. 8B, where a zone image data block cluster corresponds to a compensation curve, and referring to FIG. 5A, the zone image data block clusters 1 and 8 correspond to the compensation curve c, the zone image data block clusters 2 and 7 correspond to the compensation curve b, and the zone image data block clusters 3, 4, 5 and 6 correspond to the compensation curve a; and further referring to FIG. 5B, the zone image data block clusters 1, 3, 7 and 9 correspond to the compensation curve c, the zone image data block clusters 2, 4, 6 and 8 correspond to the compensation curve b, and the zone image data block cluster 5 corresponds to the compensation curve a. Stated otherwise, the compensation curve is set corresponding to the backlight value adjustment curve.

Particularly each grayscale compensation curve in FIG. 8B is as illustrated in FIG. 8A, and the grayscale compensation curve b is an inverted "S"-like curve, where the traversal axis represents an input grayscale value, the vertical axis represents an output grayscale value, the compensation coefficient is the ratio of output image brightness to input image brightness, and a reference line a represents a reference line with the compensation coefficient of 1. Here low input image brightness lies in a low brightness compensation interval, and high input image brightness lies in a high brightness compensation interval; and the low brightness compensation interval and the high brightness compensation interval are partitioned by a threshold of the input image brightness value on the traversal axis. The compensation coefficient of more than 1 in the low brightness compensation interval lies above the reference line a; and the compensation coefficient of less than 1 in the high brightness compensation interval lies below the reference line a, respectively.

It shall be noted that those skilled in the art can select the range of the low brightness compensation interval and the range of the high brightness compensation interval as particularly required for the design. Moreover the varying trend of the curve can be a folded line or a smooth curve, and the compensation coefficient in the high brightness compensation interval varies in such a trend that it firstly decreases from 1 to the minimum value gradually, and then increases from the minimum value to 1 gradually, and the compensation coefficient in the low brightness compensation interval varies in such a trend that it firstly increases from 1 to the maximum value gradually, and then decreases from the maximum value to 1 gradually, where the minimum value and the maximum value can be set as required for the design.

The step S62 is to determine a zone image data block with the zone backlight value below the second threshold, and to compensate for the grayscale value of each image pixel in the zone image data block using a compensation coefficient found in the determined grayscale compensation coefficient lookup table, where the compensation coefficient is more than 1.

In this embodiment, if it is determined that the backlight value of some backlight zone is below the second threshold, then a lookup table corresponding to a zone image data block cluster including the zone image data block determined in the step S61 is searched for a grayscale compensation coefficient of each pixel in the zone image data block using the grayscale value of the pixel, and the grayscale value of the pixel is multiplied with the compensation coefficient to obtain a compensated grayscale value of the pixel. It shall be noted that the determined backlight value of the backlight zone can be the pre-obtained backlight value of the backlight zone, or can be the backlight value of the zone to which the gain is applied, although the invention will not be limited thereto.

Stated otherwise, in a zone of a picture at low brightness, in order to address an improvement of the sense of hierarchy in the displayed image, grayscale brightness of respective image pixels in the zone will be improved differently Furthermore, in order to prevent display brightness of the image from being saturated due to the improvement of the backlight peak brightness in the zone, and the hierarchy at high brightness from being consequentially degraded, in another embodiment of this disclosure, if it is determined that the backlight value of the zone is above a fourth threshold, then a lookup table is searched in the high brightness compensation interval for a compensation coefficient using the grayscale value of each image pixel in the zone image data block, and the grayscale value of the image pixel is compensated for using the compensation coefficient to obtain compensated image data for driving the liquid crystal panel, where the compensation coefficient is less than 1.

Stated otherwise, in a zone of a picture at low brightness, in order to address an improvement of the sense of hierarchy in the displayed image, grayscale brightness of respective image pixels in the zone will be improved differently; and in a zone of a picture at high brightness, backlight brightness is also improved in this first embodiment, and in order to prevent display brightness of the image from being saturated due to the improvement of the backlight peak brightness, and the hierarchy at high brightness from being consequentially degraded, the grayscale brightness of the respective image pixels in the zone can be lowered differently to thereby alleviate the problem of the peak brightness being saturated due to the improved backlight values.

It shall be noted that in this first embodiment, in the areas of the pictures at low brightness, since the backlight brightness thereof is not a bottleneck limiting the brightness of the displayed image, the grayscale values of the pixels can be compensated for in this embodiment by compensating for the grayscale values of the respective pixels so that the different grayscale values of the different pixels are compensated for by different compensation amplitudes, thus improving the difference in brightness between the displayed pictures of the image so as to enhance the sense of hierarchy. A bottleneck limiting the display brightness of the image in the area of the picture at high brightness is the backlight peak brightness; and if the grayscale values of the pixels in the image are compensated for, then the brightness of the displayed image cannot be improved due to the limited maximum backlight peak brightness, so the backlight peak brightness will be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of a backlight zone in an area of a picture at high brightness to improve the sense of hierarchy in the picture, so that the overall sense of hierarchy in the image can be improved to thereby improve the effect of the dynamic contrast of the pictures.

Figure 10:
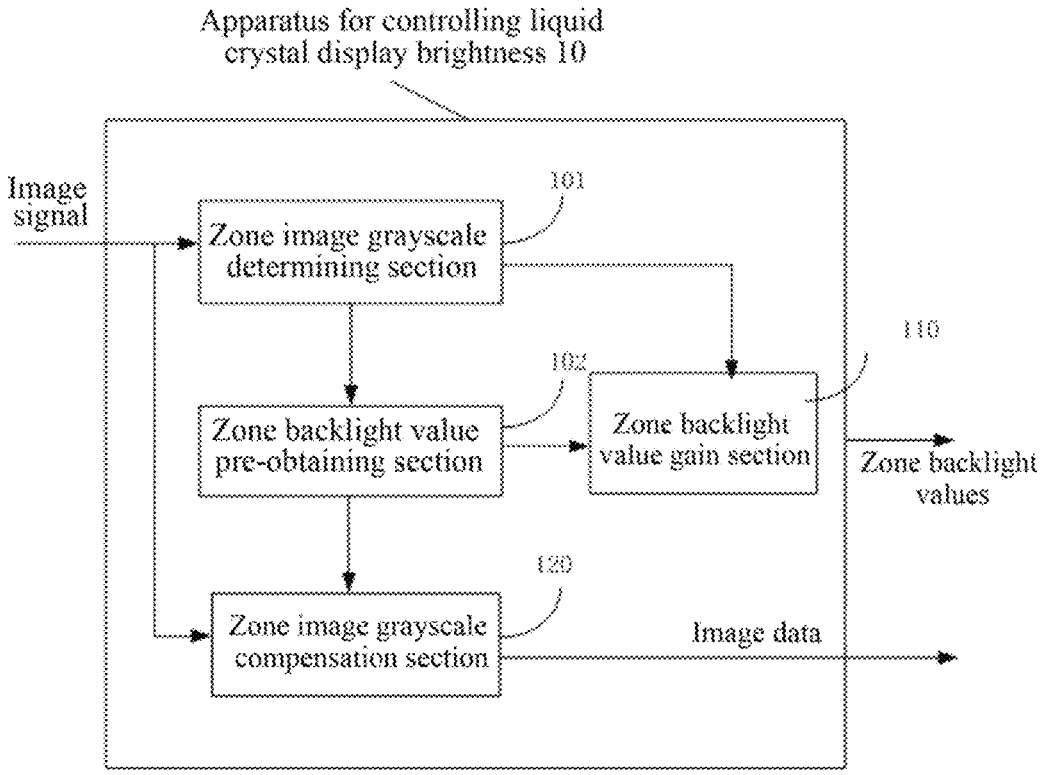
FIG. 10 is a schematic structural diagram of an apparatus for controlling liquid crystal display brightness according to a second embodiment of this disclosure.

FIG. 10 is a schematic structural diagram of an apparatus for controlling liquid crystal display brightness according to a second embodiment of this disclosure, the apparatus 10 for controlling liquid crystal display brightness can be a single video processing chip or a number of video processing chips, e.g., two video processing chips, and the apparatus 10 for controlling liquid crystal display brightness can include:

A zone image grayscale determining section 101 is configured to determine image grayscale values in a zone image data block under a predetermined rule according to a received image signal;

A zone backlight value pre-obtaining section 102 is configured to pre-obtain a zone backlight value corresponding to the zone image data block according to the image grayscale values; and A zone backlight value gain section 110 is configured, when it is determined that the zone backlight value is above a first threshold, to multiply the pre-obtained zone backlight value with a backlight value gain coefficient to obtain a backlight value to which a gain is applied, corresponding to the zone image data blocks, and to output the backlight value to which the gain is applied, to a driver circuit of backlight source in a corresponding backlight zone corresponding to the zone image data block to control brightness of the backlight source in the backlight zones as a result of driving, where the backlight value gain coefficient is more than 1.

Figure 11:
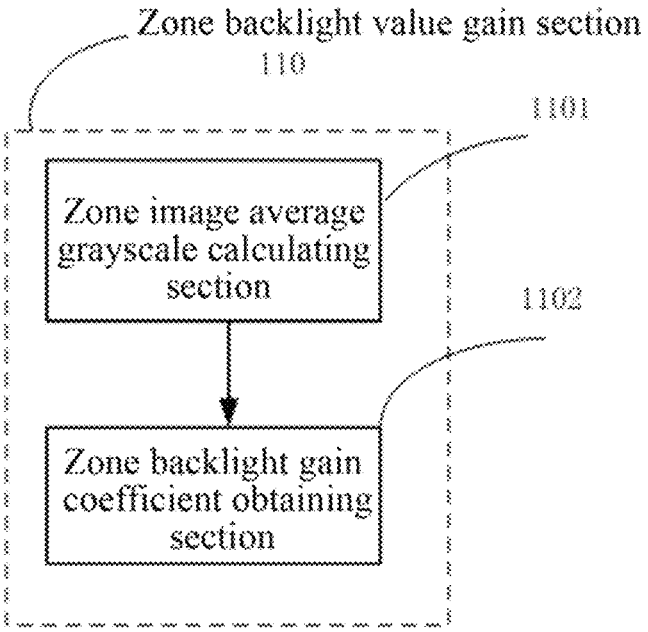
FIG. 11 is a schematic structural diagram of a zone backlight value gain section 110 in the second embodiment.

Furthermore FIG. 11 is a schematic structural diagram of the zone backlight value gain section 110 according to this second embodiment, where the zone backlight value gain section 110 can include:

A zone image grayscale average calculating section 1101 is configured to obtain an average grayscale value of all pixels in a zone image data block cluster, where all zone image data blocks are determined as a number of the zone image data block clusters, each of which includes a number of adjacent zone image data blocks; and A zone backlight gain coefficient obtaining module 1102 is configured to determine the backlight value gain coefficient according to a relationship between the zone image data block cluster and the backlight value gain coefficient.

The zone backlight value gain section 110 can be further configured to preset a number of gain coefficient lookup tables, where there are at least two zone image data block clusters corresponding to different lookup tables in which different relationships between the backlight value gain coefficient and the average grayscale value are recorded.

The zone backlight value gain section 110 can be further configured:

To match a gain coefficient relationship lookup table to the position where a zone image data block cluster is distributed on a display area.

A gain curve between the average grayscale value and the backlight value gain coefficient is recorded in each of the backlight value gain coefficient lookup tables, where the gain curve is divided into a low brightness enhancement interval, a high brightness enhancement interval, and a power control interval while the average grayscale value of the image is increasing, and the gain coefficient in the high brightness enhancement interval is more than those in the low brightness enhancement interval and the power control interval respectively.

The apparatus for controlling liquid crystal display brightness further includes a zone image grayscale compensating section 120 configured, when it is determined that the zone backlight value is below a second threshold, to compensate for the grayscale values of pixels of an image in a zone image data block using a compensation coefficient to obtain compensated image data for driving the liquid crystal panel, where the compensation coefficient is more than 1.

Figure 12:
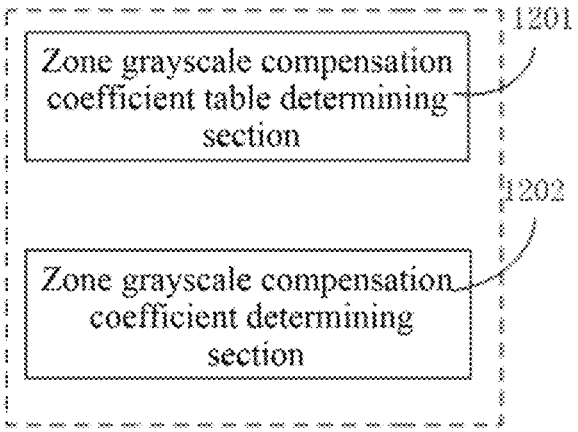
FIG. 12 is a schematic structural diagram of a zone image grayscale compensation section 120 in the second embodiment.

Furthermore, FIG. 12 is a schematic structural diagram of the zone image grayscale compensating section 120 according to this second embodiment, where the zone image grayscale compensating section 120 includes:

A zone grayscale compensation coefficient lookup table determining section 1201 is configured to determine a grayscale compensation coefficient lookup table corresponding to a zone image data block cluster including the zone image data block, where all zone image data blocks are determined as a number of the zone image data block clusters, each of which includes a number of adjacent zone image data blocks; and A zone grayscale compensation coefficient determining section 1202 is configured to determine a zone image data block with the zone backlight value below the second threshold, and to compensate for the grayscale value of each image pixel in the zone image data block using a compensation coefficient found in the determined grayscale compensation coefficient lookup table, where the compensation coefficient is more than 1.

The zone grayscale compensation coefficient lookup table determining section 1201 is further configured to preset a number of compensation coefficient lookup tables, where there are at least two zone image data block clusters corresponding to different compensation coefficient lookup tables in which different relationships between the compensation coefficient and the zone backlight value are recorded.

The zone grayscale compensation coefficient lookup table determining section 1201 is further configured to search a grayscale compensation coefficient lookup table for the grayscale compensation coefficient using the grayscale value in the zone image data block, where a correspondence relationship between the grayscale value and the grayscale compensation coefficient is recorded in the grayscale compensation coefficient lookup table.

A compensation curve of the correspondence relationship between the image grayscale value and the grayscale compensation coefficient is an inverted "S"-like curve, where the traversal axis of the inverted "S"-like curve represents an input image grayscale value, and the vertical axis thereof represents an output image grayscale value.

For details about the functions and processing flows of the respective modules in the apparatus for controlling liquid crystal display brightness according to this second embodiment, reference can be made to the detailed description of the method for controlling liquid crystal display brightness according to the first embodiment above, so a repeated description thereof will be omitted here.

In this second embodiment, as can be apparent from the analysis above, in the areas of the pictures at low brightness, since the backlight brightness thereof is not a bottleneck limiting the brightness of the displayed image, the grayscale values of the pixels can be compensated for in this embodiment by compensating for the grayscale values of the respective pixels, and the compensated image data can be used to drive the liquid crystal panel to display the image, where the different grayscale values of the different pixels are compensated for by different compensation amplitudes, thus improving the difference in brightness between the displayed pictures of the image so as to enhance the sense of hierarchy. A bottleneck limiting the display brightness of the image in the area of the picture at high brightness is the backlight peak brightness; and if the grayscale values of the pixels in the image are compensated for, then the brightness of the displayed image cannot be improved due to the limited maximum backlight peak brightness, so the backlight peak brightness of the zone will be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of the backlight zone in an area of a picture at high brightness to improve the sense of hierarchy in the picture, so that the overall sense of hierarchy in the image can be improved to thereby improve the effect of the dynamic contrast of the pictures.

Figure 13:
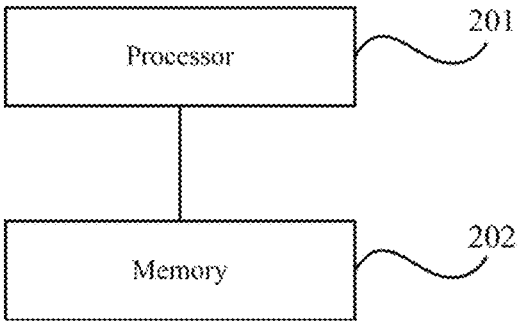
FIG. 13 is another schematic structural diagram of the apparatus for controlling liquid crystal display brightness according to the second embodiment of this disclosure.

FIG. 13 is another schematic structural diagram of the apparatus for controlling liquid crystal display brightness according to the second embodiment of this disclosure, and as illustrated in FIG. 13, the apparatus for controlling liquid crystal display brightness includes at least one processor 201, and a memory 202 storing at least one instruction executable by the at least one processor 201, where the at least one instruction is configured to be executed by the at least one processor 201 so that the apparatus for controlling liquid crystal display brightness determines image grayscale values in a zone image data block under a predetermined rule according to a received image signal, and pre-obtains a zone backlight value corresponding to the zone image data block according to the image grayscale values; and when it is determined that the zone backlight value is above a first threshold, then the apparatus for controlling liquid crystal display brightness multiplies the pre-obtained zone backlight value with a backlight value gain coefficient to obtain a backlight value to which a gain is applied, corresponding to the zone image data block, and outputs the backlight value to which the gain is applied, to a driver circuit of backlight source in a backlight zone corresponding to the zone image data block to control brightness of the backlight source in the backlight zone as a result of driving, where the backlight value gain coefficient is more than 1.

The at least one instruction can be further configured to be executed by the at least one processor 201 so that the apparatus for controlling liquid crystal display brightness obtains an average grayscale value of all pixels in a zone image data block cluster, where all zone image data blocks are determined as a number of the zone image data block clusters, each of which includes a number of adjacent zone image data blocks; and determines the backlight value gain coefficient according to a relationship between the zone image data block cluster and the backlight value gain coefficient.

A number of gain coefficient lookup tables are further preset in the memory 202, where there are at least two zone image data block clusters corresponding to different lookup tables in which different relationships between the backlight value gain coefficient and the average grayscale value are recorded.

The at least one instruction can be further configured to be executed by the at least one processor 201 so that the apparatus for controlling liquid crystal display brightness matches a gain coefficient relationship lookup table to the position where the zone image data block cluster is distributed on a display area.

The at least one instruction can be further configured to be executed by the at least one processor 201 so that when it is determined that the zone backlight value is below a second threshold, the apparatus for controlling liquid crystal display brightness compensates for grayscale values of pixels of an image in a zone image data block using a compensation coefficient to obtain compensated image data for driving the liquid crystal panel, where the compensation coefficient is more than 1.

The at least one instruction can be further configured to be executed by the at least one processor 201 so that the apparatus for controlling liquid crystal display brightness determines a grayscale compensation coefficient lookup table corresponding to the zone image data block cluster; and determines a zone image data block with the zone backlight value below the second threshold, and compensates for the grayscale value of each pixel in the zone image data block using a compensation coefficient found in the determined grayscale compensation coefficient lookup table, where the compensation coefficient is more than 1.

A number of compensation coefficient lookup tables are further preset in the memory 202, where there are at least two zone image data block clusters corresponding to different compensation coefficient lookup tables in which different relationships between the compensation coefficient and the zone backlight value are recorded.

The at least one instruction can be further configured to be executed by the at least one processor 201 so that the apparatus for controlling liquid crystal display brightness searches a grayscale compensation coefficient lookup table for the grayscale compensation coefficient using the grayscale value in the zone image data block, where a correspondence relationship between the image grayscale value and the grayscale compensation coefficient is recorded in the grayscale compensation coefficient lookup table.

Figure 14:
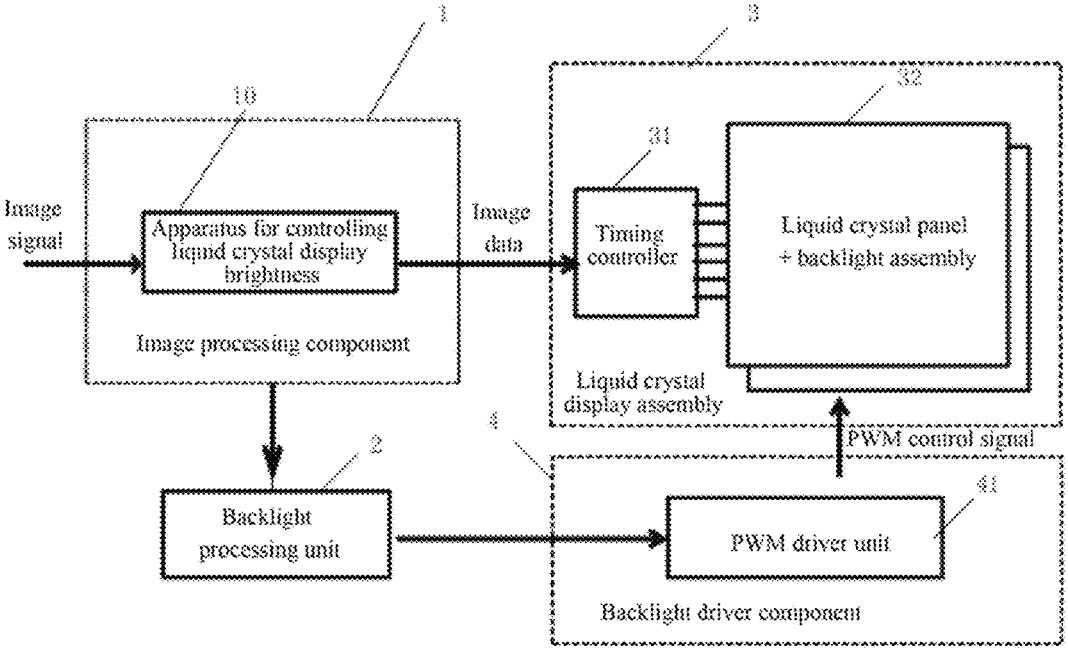
FIG. 14 is a schematic structural diagram of a liquid crystal display device according to a third embodiment of this disclosure.

FIG. 14 is a schematic structural diagram of a liquid crystal display device according to a third embodiment of this disclosure, where the liquid crystal display device includes an image processing component 1, a memory (not illustrated), a liquid crystal display module 3, a backlight processing unit 2, and a backlight driver component 4, where:

The memory is configured to store programs and various preset lookup table data;

The image processing component 1 includes the apparatus 10 for controlling liquid crystal display brightness configured to receive an image signal, to process the data, and to output the image data to a timing controller (Tcon) in the liquid crystal display component 3 so that the Tcon generates a driver signal according to the image data to control a liquid crystal panel to display the image; and further configured to output zone backlight values to the backlight processing unit 2 according to the image signal;

The backlight processing unit 2 is configured to determine duty ratios of corresponding PWM signals according to the respective zone backlight values, and to output the duty ratios to a PWM driver unit 41 in the backlight driver component 4; and The PWM driver unit 41 is configured to generate PWM control signals to control backlight sources of zones in the backlight component 32.

Here the apparatus 10 for controlling liquid crystal display brightness is any one of apparatuses for controlling liquid crystal display brightness according to the second embodiment, so a repeated description of the particular functions of the apparatus 10 for controlling liquid crystal display brightness is will be omitted here.

Those ordinarily skilled in the art can appreciate that all or a part of the steps in the methods according to the embodiments described above can be performed by program instructing relevant hardware, where the programs can be stored in a computer readable storage medium, and the programs can perform one or a combination of the steps in the method embodiments upon being executed; and the storage medium includes an ROM, an RAM, a magnetic disc, an optical disk, or any other medium which can store program codes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An apparatus for controlling liquid crystal display brightness, the apparatus comprising:

a zone image grayscale determining section configured to determine grayscale values of pixels in a zone image data block under a predetermined rule according to a received image signal;

a zone backlight value pre-obtaining section configured to pre-obtain a zone backlight value corresponding to the zone image data block according to the grayscale values;

a zone backlight value gain section configured, when it is determined that the zone backlight value is above a first threshold, to multiply the zone backlight value with a backlight value gain coefficient to obtain a backlight value, to which a gain is applied, corresponding to the zone image data block, and to output the backlight value to which the gain is applied to a driver circuit of backlight source in a backlight zone corresponding to the zone image data block to control brightness of the backlight source in the corresponding backlight zone as a result of driving, where the backlight value gain coefficient is more than 1; and a zone image grayscale compensating section configured, when it is determined that the zone backlight value is below a second threshold, to compensate for the grayscale values of pixels in the zone image data block using compensation coefficients to obtain compensated image data for driving the liquid crystal panel, wherein each of the compensation coefficients is more than 1, and the zone image grayscale compensating section comprises:

a zone grayscale compensation coefficient lookup table determining section configured to determine a grayscale compensation coefficient lookup table corresponding to a zone image data block cluster comprising the zone image data block, wherein all zone image data blocks are determined as a number of the zone image data block clusters, and each of the zone image data block clusters comprises a number of adjacent zone image data blocks; and a zone grayscale compensation coefficient determining section configured to search the determined grayscale compensation coefficient lookup table for the compensation coefficients using the grayscale values of pixels in the zone image data block.

2. The apparatus according to claim 1, wherein the zone image grayscale compensating section is configured:

to preset a number of grayscale compensation coefficient lookup tables, wherein at least two of the zone image data block clusters correspond to different grayscale compensation coefficient lookup tables in which different relationships between a compensation coefficient and a grayscale value are recorded.

3. The apparatus according to claim 2, wherein a compensation curve of a correspondence relationship between a compensation coefficient and a grayscale value is an inverted "S"-like curve, wherein a traversal axis of the inverted "S"-like curve represents an input grayscale value, and a vertical axis thereof represents an output grayscale value.

4. The apparatus according to claim 1, wherein the zone backlight value gain section comprises:

a zone image grayscale average calculating section configured to obtain an average grayscale value of pixels in at least one of the zone image data block clusters; and a zone backlight gain coefficient obtaining module configured to determine the backlight value gain coefficient according to a relationship between the average grayscale value and the backlight value gain coefficient.

5. The apparatus according to claim 4, wherein the zone backlight value gain section is configured:

to preset a number of backlight value gain coefficient lookup tables, wherein at least two of the zone image data block clusters correspond to different backlight value gain coefficient lookup tables in which different relationships between a backlight value gain coefficient and an average grayscale value are recorded.

6. The apparatus according to claim 5, wherein the zone backlight value gain section is configured:

to match a backlight value gain coefficient relationship lookup table to the position where at least one of the zone image data block clusters is distributed on a display area.

7. The apparatus according to claim 6, wherein:

a gain curve between an average grayscale value and a backlight value gain coefficient is recorded in each of the backlight value gain coefficient lookup tables, wherein the gain curve is divided into a low brightness enhancement interval, a high brightness enhancement interval, and a power control interval while the average grayscale value is increasing, and wherein the backlight value gain coefficients in the high brightness enhancement interval are more than those in the low brightness enhancement interval and the power control interval.

8. A liquid crystal display device, comprising:

a memory configured to store programs and various data;

an apparatus for controlling liquid crystal display brightness, the apparatus configured to receive an image signal, to process the data, to output image data to a timing controller so that the timing controller generates a driver signal according to the image data to control a liquid crystal panel to display an image, and to output zone backlight values;

a backlight processing unit configured to determine duty ratios of corresponding PWM signals according to the zone backlight values, and to output the duty ratios; and a PWM driver unit configured to generate PWM control signals according to the duty ratios to control backlight sources in backlight zones;

wherein the apparatus for controlling liquid crystal display brightness comprises:

a zone image grayscale determining section configured to determine grayscale values of pixels in a zone image data block under a predetermined rule according to a received image signal;

a zone backlight value pre-obtaining section configured to pre-obtain a zone backlight value corresponding to the zone image data block according to the grayscale values;

a zone backlight value gain section configured, when it is determined that the zone backlight value is above a first threshold, to multiply the pre-obtained zone backlight value with a backlight value gain coefficient to obtain a backlight value, to which a gain is applied, corresponding to the zone image data block, and to output the backlight value to which the gain is applied to a driver circuit of backlight source in a backlight zone comprising the zone image data block to control brightness of the backlight source in the backlight zone as a result of driving, where the backlight value gain coefficient is more than 1; and a zone image grayscale compensating section configured, when it is determined that the zone backlight value is below a second threshold, to compensate for the grayscale values of pixels in the zone image data block using compensation coefficients to obtain compensated image data for driving the liquid crystal panel, wherein each of the compensation coefficients is more than 1, and the zone image grayscale compensating section comprises:

a zone grayscale compensation coefficient lookup table determining section configured to determine a grayscale compensation coefficient lookup table corresponding to a zone image data block cluster comprising the zone image data block, wherein all zone image data blocks are determined as a number of the zone image data block clusters, and each of the zone image data block clusters comprises a number of adjacent zone image data blocks; and a zone grayscale compensation coefficient determining section configured to search the determined grayscale compensation coefficient lookup table for the compensation coefficients using the grayscale values of pixels in the zone image data block.

9. The liquid crystal display device according to claim 8, wherein the zone image grayscale compensating section is configured:

to preset a number of grayscale compensation coefficient lookup tables, wherein at least two zone image data block clusters correspond to different grayscale compensation coefficient lookup tables in which different relationships between a compensation coefficient and a grayscale value are recorded.

10. The liquid crystal display device according to claim 8, wherein the zone backlight value gain section comprises:

a zone image grayscale average calculating section configured to obtain an average grayscale value of all pixels in at least one of the zone image data block clusters; and a zone backlight gain coefficient obtaining module configured to determine a backlight value gain coefficient according to a relationship between the average grayscale value and the backlight value gain coefficient.

11. The apparatus according to claim 10, wherein the zone backlight value gain section is configured:

to preset a number of backlight value gain coefficient lookup tables, wherein at least two zone image data block clusters correspond to different backlight value lookup tables in which different relationships between a backlight value gain coefficient and an average grayscale value are recorded.

12. A method for controlling liquid crystal display brightness, the method comprising:

determining, by a liquid crystal display device, grayscale values of pixels in a zone image data block under a predetermined rule according to a received image signal, and pre-obtaining a zone backlight value corresponding to the zone image data block according to the grayscale values;

multiplying, by the liquid crystal display device, the zone backlight value with a backlight value gain coefficient to obtain a backlight value, to which a gain is applied, corresponding to the zone image data block when it is determined that the zone backlight value is above a first threshold, and outputting, by the liquid crystal display device, the backlight value to which the gain is applied to a driver circuit of backlight source in a backlight zone corresponding to the zone image data block to control brightness of the backlight source in the backlight zone as a result of driving, wherein the backlight value gain coefficient is more than 1; and compensating, by the liquid crystal display device, for the grayscale values of pixels in the zone image data block using compensation coefficients to obtain compensated image data for driving a liquid crystal panel when it is determined that the zone backlight value is below a second threshold, wherein each of the compensation coefficients is more than 1.

13. The method according to claim 12, wherein the compensation coefficients are obtained by:

determining, by the liquid crystal display device, a grayscale compensation coefficient lookup table corresponding to a zone image data block cluster comprising the zone image data block, wherein all zone image data blocks are determined as a number of zone image data block clusters, and each of the zone image data block clusters comprises a number of adjacent zone image data blocks; and searching, by the liquid crystal display device, the determined grayscale compensation coefficient lookup table for the compensation coefficients using the grayscale values of the pixels of in the zone image data blocks.

14. The method according to claim 13, wherein a number of compensation coefficient lookup tables are preset, and at least two of the zone image data block clusters correspond to different compensation coefficient lookup tables in which different relationships between a compensation coefficient and a grayscale value are recorded.

15. The method according to claim 14, wherein:

a compensation curve of a correspondence relationship between a compensation coefficient and a grayscale value is an inverted "S"-like curve, wherein a traversal axis of the inverted "S"-like curve represents an input grayscale value, and wherein a vertical axis of the inverted "S"-like curve represents an output grayscale value.

16. The method according to claim 12, wherein the backlight value gain coefficient is obtained by:

obtaining, by the liquid crystal display device, an average grayscale value of pixels in a zone image data block cluster comprising the zone image data block, wherein all zone image data blocks are determined as a number of zone image data block clusters, and each of the zone image data block clusters comprises a number of adjacent zone image data blocks; and determining, by the liquid crystal display device, the backlight value gain coefficient according to a relationship between the average grayscale value and the backlight value gain coefficient.

17. The method according to claim 16, wherein a number of backlight value gain coefficient lookup tables are preset, and at least two of the zone image data block clusters correspond to different backlight value gain coefficient lookup tables in which different relationships between a backlight value gain coefficient and an average grayscale value are recorded.

18. The method according to claim 17, wherein a gain curve between an average grayscale value and a backlight value gain coefficient is recorded in each of the backlight value gain coefficient lookup tables, wherein the gain curve is divided into a low brightness enhancement interval, a high brightness enhancement interval, and a power control interval while the average grayscale value is increasing, and wherein backlight value gain coefficients in the high brightness enhancement interval are more than those in the low brightness enhancement interval and the power control interval.

* * * * *